United States Patent [19]

Dotzer et al.

[11] 4,032,413

[45] June 28, 1977

[54] ELECTROPLATING BATH AND METHOD FOR THE ELECTRODEPOSITION OF BRIGHT ALUMINUM COATINGS

[75] Inventors: Richard Dotzer, Nurnberg; Hans-Georg Hauschildt, Erlangen, both of Germany; Enno Todt, deceased, late of Erlangen, Germany; by Susanne Todt, legal heir; by Ruth Katharina Todt, legal heir, both of Erlangen, Germany

[73] Assignee: Siemens Aktiengesellschaft, Munich, Germany

[22] Filed: Nov. 12, 1975

[21] Appl. No.: 630,950

[30] Foreign Application Priority Data

Nov. 13, 1974 Germany ..... 2453830

[52] U.S. Cl. ..... 204/14 N; 204/DIG. 2

[51] Int. Cl.[2] ..... C25D 3/02; C25D 3/44

[58] Field of Search ..... 204/14 N, 14 R, DIG. 2

[56] References Cited

UNITED STATES PATENTS

| | | | |
|---|---|---|---|
| 2,389,179 | 11/1945 | Brown | 204/DIG. 2 |
| 3,418,216 | 12/1968 | Dotzer | 204/14 R |
| 3,672,965 | 6/1972 | Harwood | 204/14 N |
| 3,775,260 | 11/1973 | Capuano et al. | 204/14 N |

*Primary Examiner*—T. M. Tufariello

*Attorney, Agent, or Firm*—Kenyon & Kenyon, Reilly, Carr & Chapin

[57] ABSTRACT

The invention provides an electroplating bath and a method for the electrodeposition of bright aluminum coatings on metals and conductive materials with aprotic oxygen- and water-free, organo-aluminum electrolytes which contain as a brightener at least one additive with at least one sulfonamide, sulfonimide and/or carbimide group. Particularly suitable brighteners are o-benzoic acid sulfonimide, N-benzoylbenzenesulfonamide and the reaction products of o-benzoic acid sulfonimide or N-benzoylbenzenesulfonamide with aluminum triethyl.

Using the method, a fast-adhering and corrosion-resistant bright aluminum coating is obtained which finds use for decorative purposes and, generally, for corrosion protection in surface finishing, e.g., also as mirrors and reflectors for light and heat radiators.

12 Claims, No Drawings

ELECTROPLATING BATH AND METHOD FOR THE ELECTRODEPOSITION OF BRIGHT ALUMINUM COATINGS

BACKGROUND OF THE INVENTION

This invention is concerned with an electroplating bath and method for the electrode position of bright aluminum coatings on metals and conductive materials.

It is known in the art to add to aqueous electroplating baths, brightener substances, possibly along with inactive substances, in order to obtain shiny and fine-grained chromium, nickel and copper deposits on the substrates to be coated. For this purpose, organic substances such as organic sulfonic acids, among others, have been proposed; see "Praktische Galvanotechnik" (Electroplating Practice), 1970, page 155.

Aluminum in shiny or mirror-like form is of interest as a reflector for light and heat rays as well as for decorative applications, especially in conjunction with subsequent anodizing and staining and imprinting of such surfaces.

SUMMARY OF THE INVENTION

It has been found that bright aluminum coatings are obtained if one adds to an aprotic oxygen- and water-free organo-aluminum electrolytic media at least one additive as a brightener, which additive contains at least one sulfonamide sulfonimide and/or carbimide group. According to the invention, 1 to 50 g of at least one additive are contained in each liter of electrolytic medium. The addive also acts an an inhibitor of crystalline growth.

Suitable additives which act as brighteners, i.e., bring about an influence on the electrocrystallization in organo-aluminum baths, such as $(C_2H_{,5})_4N$ $Cl.2Al(C_2H_5)_3$ in a toluene solution and NaF. $2Al(C_2H_5)_3$. 3.3 $C_7H_8$, are for example: N-benzoylbenzenesulfonamide

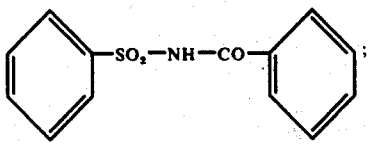

Benzene-o-disulfonimide

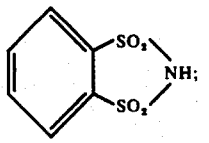

in a concentration of 1 to 12 g/l (Thiosaccharin) and Benzenesulfonic acid amide

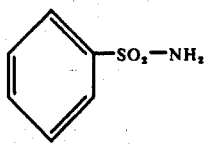

Particularly favorable results are obtained with o-benzoic acid sulfonimide

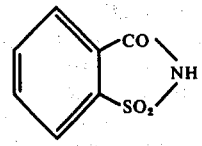

in a concentration of 1 to 22 g/l.

Particularly advantageous is o-benzoic acid sulfonimide in a concentration of 5 to 15 g/l in the complex NaF. $2Al(C_2H_5)_3$.3.3 mol toluene as the electrolyte, as far as brightness and smoothing is concerned. The bright aluminum is electrodeposited on electropolished brass or copper as well as on copper-preplated steel and on polished aluminum or aluminum alloys. With 0.5 A/dm², 2.0 V and at 70° to 80° C, one obtains with the concentration of the additive given, a highly adhering, bright aluminum deposit. The brightness of the aluminum obtained is better than 80% of a silver mirror. With brief subsequent polishing, a brightness of more than 90% of a silver mirror is obtained.

Particularly suited as the additive are also organo aluminum reaction products which are prepared from an organo aluminum compound of the general formula $AlR_3$(R = alkyl) and a compound with at least one reactable sulfonamide, sulfonimide and/or carbimide group, preferably the reaction products of Nbenzoylbenzenesulfonamide or o-benzoic acid sulfonimide with aluminum triethly. They do not react with the given electrolyte and act as brighteners immediately. In addition, they can be dosed easily to maintain the bright deposition. These reactions products can be used in solid form, but preferably as a solution.

These additives are the subject of U.S. Application Ser. No. 630,949 filed Nov. 12, 1975. According to the invention, aluminum can be applied directly in a bright or mirror-like layer on any conductive material after suitable pretreatment, particularly after electropolishing and/or brief anodic exposure.

Organic solvents can be added to the organo-aluminum electrolyte, particularly in view of an electrochemically advantageous reduction of the viscosity of the electrolyte. Particularly well suited are aromatic hydrocarbons such as, benzene, toluene, xylene and ethers, preferably higher-boiling ethers such as tetrahydrofuran, dipropyl ether, dibutyl ether, dioxane, etc. Electrolytes of this type are described, for example, in German Pat. Nos. 1,200,817 and 1,236,208.

A particularly even brightness is obtained through the addition of small quantities, i.e., 0.2 to 0.8 % by weight, based on the weight of the electrolyte, of a gelling agent such as gelatin, water-soluble cellulose ethers or the like. For the bright aluminizing, current densities of 0.1 to 10 A/dm² and preferably, 0.5 A/dm² 2A/dm², can be used, and one can work with temperatures in the range of from 50° to 120° C, preferably from 70° C to 80° C. The upper limit of the bath temperature is given by the thermal stability of the organo-aluminum electrolyte, which slowly splits off olefin above 130° C, and by the boiling point of the solvent used. The aluminum deposition can be carried out while continuously stirring, preferably and, particularly in the case of thicker aluminum layers, with a polarity reversal cycle. A particularly uniform aluminum deposit without stirring-effect shadows is obtained by the deposition of aluminum without stirring for several minutes and then stirring without aluminum deposition for several seconds. With the exclusion of air and moisture, there is obtained on the bare metal to be coated, which is free of covering layers, on or the conductive material, respectively, a silver-bright, fast-adhering, shiny coating of highly pure aluminum. The thickness of the layer is 10 to 30μm, as is customary in electroplating. However, thinner or thicker bright aluminum layers can also be deposited. The bright aluminum has a purity of at least 99.9% Al, regardless of the base material, which may consist of, for instance, copper, brass, iron, steel, aluminum, titanium, magnesium or their alloys or of other conductive materials such as, for instance, graphite. The bright electroplated aluminum layers can be eloxized and can be stained light-fast.

The additive can be added to the electrolyte as a solid, preferably as a solution, and the brightening baths can be stored for many months, provided that air and moisture are kept out.

Suitable electrolytic media are aprotic, oxygen- and water-free organo-aluminum electrolyte media, preferably aluminum alkyl-containing electrolytes. Organo-aluminum electrolytes suitable for carrying out the method according to the invention correspond to the formula;

$$MX.nAl\ R'R''R + m\ \text{solvent},$$

where M can be an alkali metal ion or a quarternary or tertiary onium ion; X is a halogen, preferably $F^-$ or $Cl^-$; $n = 1$ to 3, preferably 2 to 3; R is always an organic radical, preferably an alkyl radical, particularly ethyl or methyl; R′ and R may be the same and a hydride radical ($H^-$); R″ and R′ may be the same, with the same or different radicals and m may be from 0 to 5 (moles).

By applying defined deposition conditions such as specific current and electrolysis conditions, particularly, low initial current density for seeding (expitaxial growth), and intermittent current, the form of the electrodeposited aluminum can be influenced advantageously. In particular, the direct deposition in shiny or mirror-like form, with good adhension to pretreated surfaces of metals and conductive materials is achieved according to the invention.

The bright aluminum layers obtained in accordance with the invention can find application as mirrors and reflectors for light and heat radiators as well as ultrasonic waves for decorative purposes and for corrosion protection surface finishing. The most intricately shaped parts thus are given a decoratively advantageous appearance such as, for instance, components used in dentistry, electrotechnology and in the automotive, aeronautical and space industry.

The invention will be explained in further detail with the aid of the following Examples.

EXAMPLE 1

In a 3-liter central-electrode aluminizing cell with a 10-cm high, cylindrical anode of refined sheet and a central rotary cathode with flange-on changing lock, cylindrical sections of copper tubing, 80 mm high, with 30 mm diameter and 2 mm wall thickness, are plated on the outside with bright electroplated aluminum in this Example.

For this purpose, 0.5% (11.5 g) o-benzoic acid sulfonimide are added portion-wise to 2.3 l of oxygen- and waterfree $NaF.2Al\ (C_2H_5)_3.3.3\ C_7H_8$ under the exclusion of air and moisture and dissolved at room temperature under an inert gas ($N_2$ or Ar), while being stirred. After formation of the organoaluminum brightener, the initial completely colorless electrolytic medium shows a yellowish hue. After about 4 hours, the aluminizing bath is ready for bright-aluminum electroplating.

The sections of copper tubing had been surface-pretreated for the bright-aluminum electroplating by degreasing in a perchlorethylene steam bath and electropolishing. By immersion-drying in methanol and acetone and subsequent rinsing in toluene, the part is stored in toluene until it is bright-aluminized.

For the bright-aluminum electroplating, a section of coppeer tube, pretreated in this manner and still wet with toluene, is secured in the cathode mounting, establishing contact at the same time, and is placed in the aluminizing cell via the changing lock in dry inert gas.

With an electrolyte bath temperature of 70 to 80°, the deposition current is controlled so that, starting from zero, a cathode current density of 1.0 A/dm² is reached within 15 min; then this current density is maintained for another 60 min. During the entire aluminizing time, the deposition current is interrupted after every 2 min for a stirring period of half a minute, during which the rotary cathode with the copper tube section rotates at about 200 r.p.m. With these deposition conditions, one obtains an approximately 10-μm thick electroplated aluminum layer with a shiny surface. The brightness corresponds to about 75% of the reflectivity of a silver mirror.

In a similar manner, bright electroplated aluminum layers of up to 50 μm thickness can be produced homogeneously and silver-bright using correspondingly longer deposition times.

For eloxizing, a section of copper tube, coated with a bright electroplated aluminum layer about 25 um thick is anodized, after the bare areas of the copper surface (particularly the inside wall of the tube); are covered with acid-resistant paint, in the d.c.-sulfuric acid bath CS bath of 18° C with a current density of 1.5A/dm² for 22 min. The eloxal layer, which is about 10 um thick and colorless, can be stained gold in a staining bath consisting of 1/5 by volume Al-brass yellow MGW (about 1 g/l $H_2O$) and 4/5 by volume Al-gold-yellow GLW (about 1 g/1 $H_2O$) at 60° C for 2 min and can subsequently be condensed for 30 min in boiling water. A shiny, gold-colored aluminum-electroplated eloxal layer of great hardness and abrasion resistance is obtained.

EXAMPLE 2

To 230 ml of the complex $NaF.2Al\ (C_2H_5)_3.3.3\ C_7H_8$ are added, within 4 hours, under an inert gas, 23 g o-benzoic acid sulfonimide. After the reaction is completed, the so-formed brightening solution is allowed to cool down.

This reaction solution, which facilitates dosing considerably over the solid o-benzoic acid surfonimide, can be added directly to 2.03 1 $NaF.2Al\ (C_2H_5)_3.3.3\ C_7H_8$, which are placed in a 3-liter central-electrode aluminizing cell in accordance with Example 1. After thorough mixing and heating to 80° C, the electrolysis is commenced. The content of 10 g/1 benzoic acid sulfonimide contained in this 2.3-liter overall complex acts as a brightener or inhibitor in the cathodic deposition of aluminum.

EXAMPLE 3

In a 100-ml electrolysis cell with lateral Al anodes and a central cathode sheet of brass, 5 ml of a reaction solution of o-benzoic acid sulfonimide and $Al(C_2H_5)_3$ in a mole ratio of 1:2 in toleuene is added to 100 ml of the complex $[(C_2H_5)_4N]Cl.2Al(C_2H_5)_3$.2 mol toluene. This corresponds to a content of 10 g/l o-benzoic acid sulfonimide. In this electrolyte, 10 μm of Al are deposited in shiny form during 2 hours with 0.5 A/dm², as described in Example 1.

EXAMPLE 4

In an electrolytic cell as described in Example 3, 1 g N-benzoylbenzenesulfonamide is added to 100 ml of the complex $NaF.2Al(C_2H_5)_3$.3.3 mol toluene. Under the electrical conditions as described in Example 1, 10 um of Al are deposited on brass. A bright Al deposit is obtained.

EXAMPLE 5

The complex, $NaF.2Al(C_2H_5)_3.3.3\ C_7H_8$, as the electrolyte is placed in an electrolytic cell according to Example 1 with an anode of refined Al and a cylindrical section of copper or brass tubing as the cathode.

For 2.31 of fresh electrolyte $NaF.2Al(C_2H_5)_3$.3.3 mol toluene, 60 ml of the additive, prepared from 23 g o-benzoic acid sulfonimide and 28.7 g $Al(C_2H_5)_3$ in accordance with U.S. Application Serial No. 630,949, Filed November 12, 1975 are added. After thorough mixing at 80° C, the current density is increased within 1 hour from 0 to 0.5 A/dm² and left at this current density until the desired thickness of the deposited bright aluminum layer is reached. During the entire deposition, the current is interrupted every 2 min and the bath is stirred for 30 sec without current. The deposited aluminum layer has a brightness of about 80 % as compared with a silver mirror.

EXAMPLE 6

Work pieces of iron or steel are mechanically prepolished and electroplated with bright copper. The thickness of the bright copper layer required depends on the quality of the mechanical pre-polishing and is about 4 to 10μm.

For the bright aluminizing, the copper surface is cathodically degreased in a degreasing bath using 10 A/dm², until the surface of the work piece can be wetted perfectly, Then, it is pickled with dilute sulfuric acid, rinsed thoroughly and washed with acetone and toluene. The work piece, wet with toluene, is placed in the bright-aluminum electroplating cell and is bright-aluminized in accordance with the procedure in Example 1. Thereafter, the electrolyte is rinsed off with isopropanol. One obtains an aluminum deposit the brightness of which corresponds to about 75% of that of a silver mirror.

The brightness of the aluminum is always measured with a modified Universal Measuring Equipment of the firm Dr. Bruno Lange, Berlin. The principle of the brightness measurement is the reflection of a light beam at the surface of the object to be tested, the angle of incidence and the angle of reflection of the light beam being equal. The reflected light is measured by means of a photocell and indicated in analog form via a light galvanometer

We claim:

1. An aluminum electroplating bath comprising an aprotic oxygen- and water-free organo-aluminum electrolyte medium and at least one additive containing a brightener selected from the group consisting of a sulfonamide, sulfonimide, carbimide and mixtures thereof.

2. The electroplating bath of claim 1 wherein said additive comprises from 1 to 50 g/liter of said electrolyte medium.

3. The electroplating bath of claim 1 wherein said additive comprises from 10 to 20 g/liter of said electrolyte medium.

4. The aluminum electroplating bath of claim 1 wherein the electrolyte is $NaF.2Al(C_2H_5)_3$ in a toluene solution.

5. The aluminum electroplating bath of claim 1 wherein the electrolyte is in a toluene solution.

$[(C_2H_5)_4N][Cl.2Al(C_2H_5)_3]$

6. The aluminum electroplating bath of claim 1 wherein the additive is o-benzoic acid sulfonimide having the formula

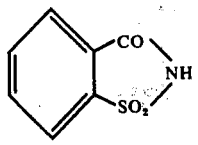

7. The aluminum electroplating bath of claim 1 wherein the additive is N-benzoylbenzene sulfonamide.

8. The aluminum electroplating bath of claim 1 wherein the additive is the reaction product of an organic compound containing a group selected from the group consisting of sulfonamide, sulfonimide, carbimide, and with mixtures thereof, with aluminum trialkyl.

9. The aluminum electroplating bath of claim 8 wherein the aluminum trialkyl is aluminum triethyl.

10. The aluminum electroplating bath of claim 8 wherein the additive is the reaction product of o-benzoic acid sulfonimide and aluminum triethyl.

11. The aluminum electroplating bath of claim 8 wherein the additive is the reaction product of N-benzoylbenzene sulfonamide and aluminum triethyl.

12. A method for electrodepositing a bright aluminum on a metal or electrically conductive substrate comprising;

a. employing said substrate as the cathode of an electrolytic cell containing an electrolytic plating bath comprising an aprotic oxygen and water-free organo-aluminum electrolyte medium and at least one additive containing a brightener selected from the group consisting of sulfonamide, sulfimide carbimide, and mixtures thereof;

b. operating said cell at temperatures from 50° to 120° C with periodic stirring using an initial current density of up to 1.0 A/dm², on operating current density of from 0.5 to 10 A/dm², and using polarity reversal cycles to deposit an aluminum coating on said substrate.

* * * * *